US008770290B2

(12) United States Patent
van Petegem et al.

(10) Patent No.: US 8,770,290 B2
(45) Date of Patent: Jul. 8, 2014

(54) GRAVEL PACK ASSEMBLY FOR BOTTOM UP/TOE-TO-HEEL PACKING

(75) Inventors: Ronald van Petegem, Montgomery, TX (US); John Broussard, Kingwood, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 562 days.

(21) Appl. No.: 12/913,981

(22) Filed: Oct. 28, 2010

(65) Prior Publication Data

US 2012/0103606 A1 May 3, 2012

(51) Int. Cl.
*E21B 43/04* (2006.01)

(52) U.S. Cl.
USPC ..... 166/278; 166/51

(58) Field of Classification Search
USPC ..... 166/51, 278
See application file for complete search history.

(56) References Cited

U.S. PATENT DOCUMENTS

| | | | | |
|---|---|---|---|---|
| 3,134,439 | A * | 5/1964 | Shields, Jr. | 166/51 |
| 4,105,069 | A | 8/1978 | Baker | |
| 4,440,218 | A | 4/1984 | Farley | |
| 4,474,239 | A | 10/1984 | Colomb et al. | |
| 5,113,935 | A * | 5/1992 | Jones et al. | 166/51 |
| 5,269,375 | A | 12/1993 | Schroeder, Jr. | |
| 5,934,376 | A | 8/1999 | Nguyen et al. | |
| 6,003,600 | A | 12/1999 | Nguyen et al. | |
| 6,253,851 | B1 | 7/2001 | Schroeder, Jr. et al. | |
| 6,371,210 | B1 | 4/2002 | Bode et al. | |
| 6,446,722 | B2 | 9/2002 | Nguyen et al. | |
| 6,588,507 | B2 | 7/2003 | Dusterhoft et al. | |
| 6,601,646 | B2 * | 8/2003 | Streich et al. | 166/278 |
| 6,675,891 | B2 | 1/2004 | Hailey, Jr. et al. | |
| 6,749,023 | B2 | 6/2004 | Nguyen et al. | |

(Continued)

FOREIGN PATENT DOCUMENTS

| | | | |
|---|---|---|---|
| GB | 2387401 | A | 10/2003 |
| RU | 1191563 | A | 11/1985 |

(Continued)

OTHER PUBLICATIONS

First Office Action in counterpart Russian Appl. No. 2011143515, dated Nov. 26, 2012.

(Continued)

*Primary Examiner* — Giovanna Wright
*Assistant Examiner* — Richard Alker
(74) *Attorney, Agent, or Firm* — Wong, Cabello, Lutsch, Rutherford & Brucculeri LLP

(57) ABSTRACT

A gravel pack assembly gravel packs a horizontal borehole. Operators wash down the borehole using a tool in a first position by flowing fluid from the tool through the apparatus' toe. Operators then gravel pack by moving the tool to a first flow port between a screen and the toe. Slurry flows into the borehole from the first flow port, and returns from the borehole flow through the screen. The gravel in the slurry can pack the borehole in an alpha-beta wave from toe to heel. When the tool has a sleeve, operators can break any bridges by flowing fluid from the passage of the assembly into the tool. In another condition, operators can move the tool to a second flow port. Slurry can flow into to the borehole through a shunt extending from the second flow port. Meanwhile, returns can flow from the borehole through a bypass in the assembly.

50 Claims, 9 Drawing Sheets

(56) References Cited

U.S. PATENT DOCUMENTS

| | | | | |
|---|---|---|---|---|
| 6,857,476 | B2 * | 2/2005 | Richards | 166/278 |
| 6,983,795 | B2 | 1/2006 | Zuklic et al. | |
| 7,017,664 | B2 | 3/2006 | Walker et al. | |
| 7,331,388 | B2 | 2/2008 | Vilela et al. | |
| 7,367,395 | B2 | 5/2008 | Vidrine et al. | |
| 7,472,750 | B2 | 1/2009 | Walker et al. | |
| 8,267,173 | B2 * | 9/2012 | Clarkson et al. | 166/278 |
| 2003/0000702 | A1 | 1/2003 | Streich | |
| 2003/0037925 | A1 | 2/2003 | Walker et al. | |
| 2004/0134656 | A1 | 7/2004 | Richards | |
| 2004/0211559 | A1 | 10/2004 | Nguyen et al. | |
| 2007/0187095 | A1 | 8/2007 | Walker et al. | |
| 2008/0099194 | A1 * | 5/2008 | Clem | 166/51 |
| 2009/0095471 | A1 | 4/2009 | Guignard et al. | |
| 2009/0133875 | A1 | 5/2009 | Tibbles et al. | |
| 2010/0096130 | A1 | 4/2010 | Parlar et al. | |
| 2010/0263864 | A1 | 10/2010 | Chay et al. | |
| 2010/0294495 | A1 | 11/2010 | Clarkson et al. | |

FOREIGN PATENT DOCUMENTS

| | | | |
|---|---|---|---|
| RU | 1810500 | A1 | 4/1993 |
| RU | 2374431 | C2 | 8/2008 |
| SU | 1191563 | A | 11/1985 |
| WO | 2005049954 | A2 | 6/2005 |
| WO | 2007126496 | | 11/2007 |

OTHER PUBLICATIONS

Extended Search Report received in counterpart European Appl. No. 12184724.8, dated Jan. 9, 2013.

Decision on Grant in counterpart Russian Appl. No. 2011143515, dated Mar. 7, 2013.

First Office Action received in counterpart Canadian Appl. No. 2,755,623, dated Jun. 14, 2013.

First Office Action received in counterpart Australian Appl. No. 2011236063, dated May 21, 2013.

Schlumberger, "Alternate Path Screens," obtained from www.slb.com/oilfield, dated Jan. 2004, 4 pages.

Schlumberger, "FloRite—Inflow control device," obtained from www.slb.com/transcend, (c) 2009, 2 pages.

Halliburton, "Sand Control: Horizon Low Density, Lightweight Gravel," obtained from www.halliburton.com, (c) 2006, 2 pages.

Edment, Brian, et al., "Improvements in Horizontal Gravel Packing," Oilfield Review, Spring 2005, pp. 50-60.

Synopsis of SPE 38640 by Jones, L.G., et al., "Shunts Help Gravel Pack Horizontal Wellbores with Leakoff Problems," Journal of Petroleum Technology, Mar. 1998, pp. 68-69.

Coronado, Martin, et al., "Completing extended-reach, open-hole, horizontal well," obtained from http://www.offshore-mag.com/index/article-tools-template, generated on May 12, 2010, 5 pages.

Schlumberger, "ResFlow Inflow Control Devices and MudSolv Filtercake Removal Equalize Inflow and Restart Wells," obtained from www.slb.com/sandcontrol, (c) 2010, 2 pages.

Jensen, Rene, et al., "World's First Reverse-Port Uphill Openhole Gravel Pack with Swellable Packers," SPE 122765, 15 pages, Copyright 2009.

Weatherford, "Model 4P Retrievable Seal-Bore Packer Gravel-Pack System," obtained from www.weatherford.com, (c) 2005-2009, 2 pages.

Brannon, D.H., et al., "A Single-Trip, Dual-Zone Gravel Pack System Successfully Gravel Packs Green Canyon Area Wells, Gulf of Mexico," SPE 21670, (c) 1991, 7 pages.

Weatherford, "Hydraulic-Release Hookup Nipple Circulating Gravel-Pack System," obtained from www.weatherford.com, (c) 2005, 2 pages.

Weatherford, "Conventional Well Screens," obtained from www.weatherford.com, (c) 2004-2009, 16 pages.

Weatherford, "Model WFX Setting Tools," obtained from www.weatherford.com, (c) 2007-2008, 2 pages.

Weatherford, "Model WFX Crossover Tool," obtained from www.weatherford.com, (c) 2007-2008, 2 pages.

Weatherford, "Real Results: Completion Package Eliminates Sand Production, Enhances Reliability in Siberian Oil-Production Well," obtained from www.weatherford.com, (c) 2009, 1 page.

Patent Examination Report No. 2 received in corresponding Australian application No. 2011236063, dated Dec. 20, 2013.

* cited by examiner

GRAVEL PACK ASSEMBLY FOR BOTTOM UP/TOE-TO-HEEL PACKING

BACKGROUND

Some oil and gas wells are completed in unconsolidated formations that contain loose fines and sand. When fluids are produced from these wells, the loose fines and sand can migrate with the produced fluids and can damage equipment, such electric submersible pumps (ESP) and other systems. For this reason, completions can require screens for sand control.

Horizontal wells that require sand control are typically open hole completions. In the past, stand-alone sand screens have been used predominately in these horizontal open holes. However, operators have also been using gravel packing in these horizontal open holes to deal with sand control issues. The gravel is a specially sized particulate material, such as graded sand or proppant, which is packed around the sand screen in the annulus of the borehole. The gravel acts as a filter to keep any fines and sand of the formation from migrating with produced fluids.

A prior art gravel pack assembly 20 illustrated in FIG. 1A extends from a packer 14 downhole from casing 12 in a borehole 10, which is a horizontal open hole. To control sand, operators attempt to fill the annulus between the assembly 20 and the borehole 10 with gravel (particulate material) by pumping slurry of fluid and gravel into the borehole 10 to pack the annulus. For the horizontal open borehole 10, operators can use an alpha-beta wave (or water packing) technique to pack the annulus. This technique uses a low-viscosity fluid, such as completion brine, to carry the gravel. The assembly 20 in FIG. 1A represents such an alpha-beta type.

Initially, operators position a wash pipe 40 into a screen 25 and pump the slurry of fluid and gravel down an inner work string 45. The slurry passes through a port 32 in a crossover tool 30 and into the annulus between the screen 25 and the borehole 10. As shown, the crossover tool 30 positions immediately downhole from the gravel pack packer 14 and uphole from the screen 25. The crossover port 32 diverts the flow of the slurry from the inner work string 45 to the annulus downhole from the packer 14. At the same time, another crossover port 34 diverts the flow of returns from the wash pipe 40 to the casing's annulus uphole from the packer 14.

As the operation commences, the slurry moves out the crossover port 32 and into the annulus. The carrying fluid in the slurry then leaks off through the formation and/or through the screen 25. However, the screen 25 prevents the gravel in the slurry from flowing into the screen 25. The fluids passing alone through the screen 25 can then return through the crossover port 34 and into the annulus above the packer 14.

As the fluid leaks off, the gravel drops out of the slurry and first packs along the low side of the borehole's annulus. The gravel collects in stages 16*a*, 16*b*, etc., which progress from the heel to the toe in what is termed an alpha wave. Because the borehole 10 is horizontal, gravitational forces dominate the formation of the alpha wave, and the gravel settles along the low side at an equilibrium height along the screen 25.

When the alpha wave of the gravel pack operation is done, the gravel then begins to collect in stages (not shown) of a beta wave. This forms along the upper side of the screen 25 starting from the toe and progressing to the heel of the screen 25. Again, the fluid carrying the gravel can pass through the screen 25 and up the wash pipe 40. To complete the beta wave, the gravel pack operation must have enough fluid velocity to maintain turbulent flow and move the gravel along the topside of the annulus. To recirculate after this point, operators have to mechanically reconfigure the crossover tool 30 to be able to washdown the pipe 40.

Although the alpha-beta technique can be economical due to the low-viscosity carrier fluid and regular types of screens that can be used, some situations may require a viscous fluid packing technique that uses an alternate path. In this technique, shunts disposed on the screen divert pumped packing slurry along the outside of the screen. FIG. 1B shows an example assembly 20 having shunts 50 and 52 (only two of which are shown). Typically, the shunts 50/52 for transport and packing are attached eccentrically to the screen 25. The transport shunts 50 feed the packing shunts 52 with slurry, and the slurry exits from nozzles 54 on the packing shunts 52. By using the shunts 50/52 to transport and pack the slurry, the gravel packing operation can avoid areas of high leak off in the borehole 10 that would tend to cause bridges to form and impair the gravel packing.

Prior art gravel pack assemblies 20 for both techniques of FIGS. 1A-1B have a number of challenges and difficulties. During a gravel pack operation in a horizontal well, for example, the crossover ports 32/34 may have to be re-configured several times. During a frac pack operation, the slurry pumped at high pressure and flow rate can sometimes dehydrate within the assembly's crossover tool 30 and associated sliding sleeve (not shown). If severe, settled sand or dehydrated slurry can stick to service tools and can even junk the well. Additionally, the crossover tool 30 is subject to erosion during frac and gravel pack operations, and the crossover tool 30 can stick in the packer 14, which can create extremely difficult fishing jobs.

To deal with gravel packing in some openhole wells, a Reverse-Port Uphill Openhole Gravel Pack system has been developed as described in SPE 122765, entitled "World's First Reverse-Port Uphill Openhole Gravel Pack with Swellable Packers" (Jensen et al. 2009). This system allows an uphill openhole to be gravel packed using a port disposed toward the toe of the hole.

The subject matter of the present disclosure is directed to overcoming, or at least reducing the effects of, one or more of the problems set forth above.

SUMMARY

A gravel pack assembly gravel packs a borehole, which can be a horizontal, deviated, or other type of borehole. Operators can initially washdown the borehole using a tool in a first position by flowing fluid from the tool through the assembly's toe, which has a toe port. (Gravel packing can also be initiated through the toe port if desired.) After washing down, operators move the tool to a first flow port between a screen and the toe to begin gravel packing. Slurry flows into the borehole from the first flow port, and returns from the borehole through the screen. The gravel in the slurry can pack the borehole in an alpha-beta wave or some variation thereof from toe to heel.

When the tool has a sleeve, operators can break bridges that may have developed by shifting the sleeve on the tool. This allows a reverse flow of fluid to pass from the passage of the assembly into the tool. In another condition, operators can move the tool to a second flow port on the assembly to continue gravel packing or to evacuate excess gravel from the tool. For example, slurry can flow into to the borehole through an alternate path device or shunt extending from the second flow port. This flow of slurry can pack part of the annulus of the borehole and can be done to get ride of excess gravel in the tool downhole. Meanwhile, returns can flow from the borehole through a bypass in the assembly.

In one arrangement, a gravel pack assembly has a screen disposed on the assembly that communicates the passage in the assembly with the annulus of a surrounding borehole. A float shoe on the toe of the assembly controls fluid flow from the passage through a first port defined in the toe. A tool movably disposes in the screen and has a sleeve movably disposed thereon. The sleeve has a port movable relative to the port of the assembly and to the open end of the string.

In another arrangement, a gravel pack assembly has a service tool assembly, a packer, and a screen assembly. The service tool assembly has a hydraulic setting tool that makes up to the packer and has an inner work string made up to the bottom of the setting tool. The inner work string runs inside the screen assembly and can seal at the bottom of the assembly.

After the packer is set and when it is desired to move the inner work string into a gravel pack position, the service tool assembly and inner work string are moved to locate to a point in the screen assembly for delivering sand slurry into the annulus around the screen. To accomplish this delivery, the inner work string has seal subs located on either side of a ported housing. When fluid is pumped through the inner work string, the exit point for the slurry is aligned with a ported housing on the screen assembly. Thus, pumped fluid can exit into the annulus around the screen assembly at multiple selective points.

The disclosed gravel pack assembly eliminates the complexity associated with conventional crossover tool mechanisms that can cause problems. The assembly can be used for either alpha-beta wave, alternative path, or other style of gravel pack operation. Preferably, the assembly uses only a single string of pipe run as the inner work string, although concentric strings of pipe could also be used.

Along the length of the assembly, multiple ported housings may be installed between screens. The ported housing start at the bottom the assembly and are then interspersed along the length of the assembly. This provides the assembly with multiple slurry packing points that can be useful for packing long zones.

For washing down, the end of this inner work string can seal off and direct fluid flow through a check valve on the float shoe on the end of the assembly. Pumped fluids travel down the inner work string and exit through the valve. For gravel packing, the port on the work string locates in one of the gravel pack ported housings to deliver slurry into the screen annulus at desired locations. For example, each ported housing of the assembly can direct the slurry directly into the annulus. Alternatively, the ported housing can direct the slurry into shunts.

Because the assembly may have a single string of pipe for the inner work string (as opposed to running two concentric strings), reversing out excess sand slurry in the inner work string can cause pressure applied to the casing to transmit to the exposed open hole interval through the screen assembly. After achieving 'sandout' during the gravel pack operation, for example, operators typically remove any gravel remaining in the work string as a standard practice so that the gravel does not plug the work string or fall into the well.

To deal with these issues, the assembly preferably allows operators to evacuate excess slurry (e.g., gravel) from the work string. At the end of the gravel pack operation, the interior space inside the shoe track as well as the exterior space outside the track provides a volumetric space for disposing of any gravel remaining in the work string. In one arrangement, the excess gravel can be placed inside and/or outside the shoe track. Alternatively, the excess gravel can be pumped above the sand column in the annulus using shunts or other alternate path devices.

The foregoing summary is not intended to summarize each potential embodiment or every aspect of the present disclosure.

DETAILED DESCRIPTION

Figure 1A:
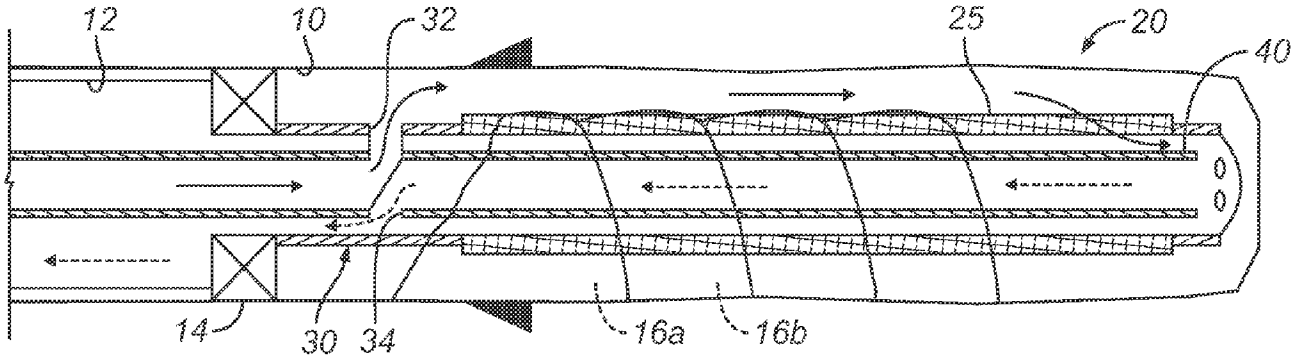
FIG. 1A (Prior Art)
FIGS. 1A-1B illustrate gravel pack assemblies according to the prior art.
Figure 1B:
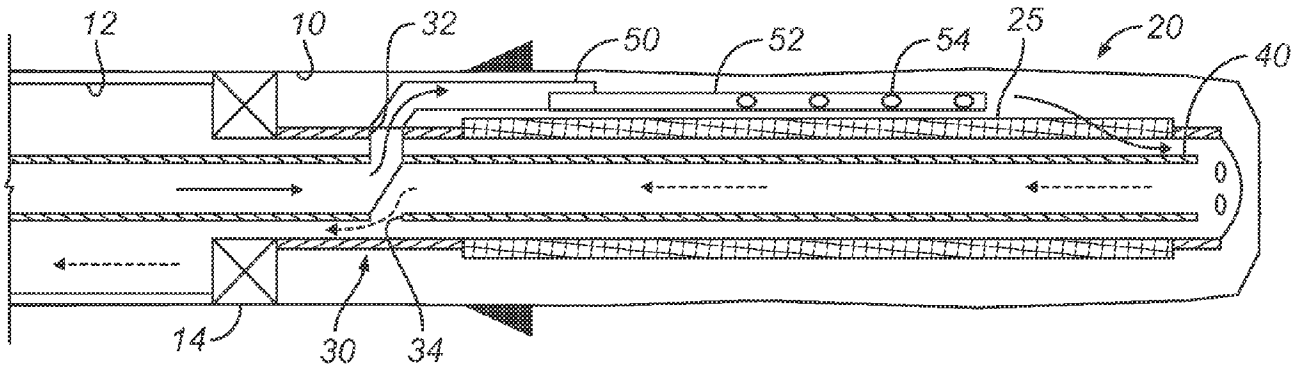
FIG. 1B (Prior Art)
Figure 2A:
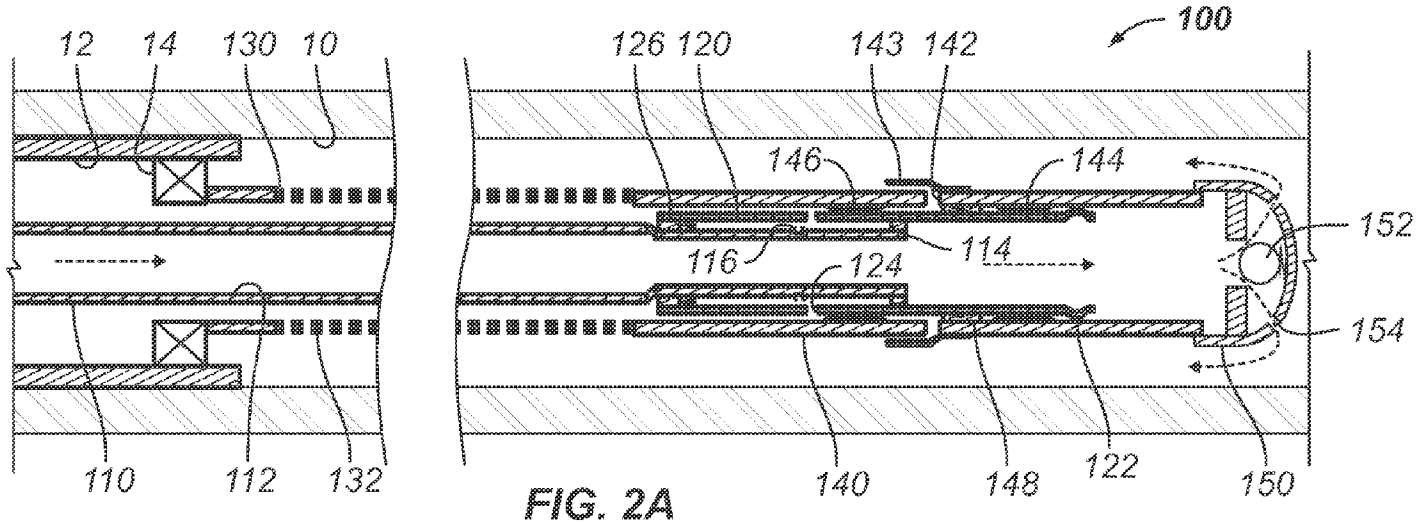
FIG. 2A shows a gravel pack assembly according to the present disclosure being run-in hole for a wash down operation.

A gravel pack assembly 100 in FIG. 2A is shown run-in hole for a wash down and gravel pack operation. The assembly 100 extends from a packer 14 downhole from casing 12 in a borehole 10. In the present example, the borehole 10 is a horizontal or highly deviated open hole; however, the assembly 100 can be used in other types of boreholes. The assembly 100 has a toe or distal end extending from a heel or proximal end near the packer 14. In general, the heel refers to the section just downhole from the casing shoe, whereas the toe refers to the section toward total depth (TD) of the well.

The assembly 100 has a screen section 130 with a shoe track 140 and float shoe 150 on its distal end. Internally, an inner work string or tool 110 for the assembly disposes through the screen section 130 and into the shoe track 140. The screen section 130 has one or more screens 132, which can include wire-wrapped screens, pre-packed screens, direct-wrapped screens, meshes, etc. The shoe track 140 has one or more body or flow ports 142.

The inner work string 110 has an extension or sleeve 120, and a retainer 126 connects the sleeve 120 onto the inner work string 110. (The retainer 126 can be a C-ring or other type of retainer.) The sleeve 120 has a catch 122 on the end thereof. If needed, a safety release can be provided on the distal end on the work string 110 so the inner work string 110 can detach from the sleeve 120. For example, the safety release can be provided at the retainer 126.

The inner work string 110 has a passage 112 with an open end or string port 114 for entry and exit of fluid. The sleeve 120 is movably disposed on the inner work string 110 and seals against the open end 114. Depending on the sleeve's position, intermediate or sleeve ports 124 on the sleeve 120 may or may not communicate with the open end 114 of the inner work string 110 and any body or flow ports 142 on the shoe track 140. In any event, seats or seals 144/146 on the inside of the housing 140 can sealably engage the inner work string 110 and can isolate the external flow ports 142 in the shoe track 140. Additionally, a sliding sleeve 148 disposed in the shoe track 140 can engage the inner work string 110 and can move relative to the external flow ports 142.

As shown in FIG. 2A, fluid is pumped down the inner work string 110 during run-in for initial wash down or gravel packing. The fluid passes all the way through the inner work string 110 without passing through ports 124 or 142. Instead, the fluid reaches the float shoe 150, and the fluid pressure causes the check valve 152 to open. Consequently, the wash down or slurry leaves the toe ports 154 in the shoe 150. To wash the borehole 10, the fluid travels up the annulus, through the screen 132, and into the annulus between inner work string 110 and screen 132. Otherwise, the fluid can be slurry and can begin gravel packing the borehole with the returns passing through the screen 132.

Figure 2B:
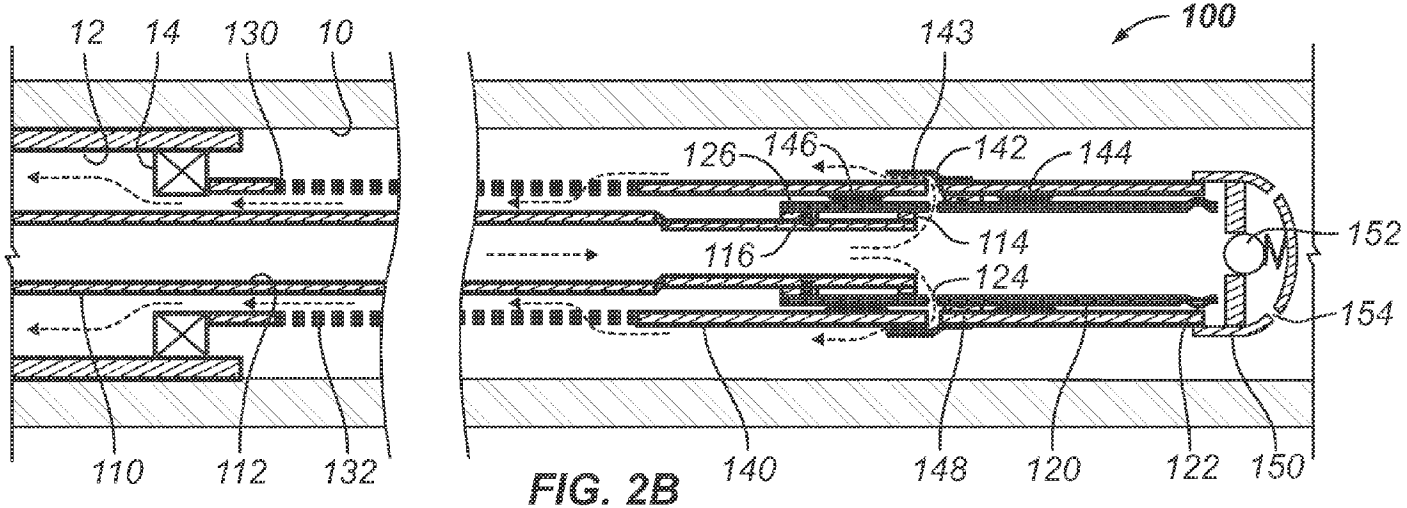
FIG. 2B shows the gravel pack assembly during a gravel pack operation.

After this initial stage, the assembly 100 is transitioned for gravel packing through flow ports 142. As shown in FIG. 2B, the inner work string 110 is first shifted uphole so that the retainer 126 engages in a locking slot 116 on the inner work string 110. Once engaged, the sleeve 120 moves with the inner work string 110, and both are moved downhole further into the shoe track 140 until positioned as shown in FIG. 2B. In this position, the intermediate ports 124 in the sleeve 120 can communicate with the external flow ports 142 in the shoe track 140.

Operators then pump slurry having a carrying fluid (e.g., completion brine) and particulate material (e.g., sand, proppant, gravel, etc.) down the inner work string 110. The pumped slurry no longer passes through the shoe 150 and instead passes through the open ports 124/142. On the outside of the shoe track 140, a skirt 143 can surround the external flow ports 142. This skirt 143 acts to prevent erosion of the borehole 10 as the slurry exits the shoe track 140 into the surrounding annulus.

As the slurry is pumped through the open assembly 100, the slurry flows into the annulus surrounding the sand screen 132 from the toe up to the heel of the assembly 100. As the slurry moves out the port 142 and into the annulus, the carrying fluid in the slurry then leaks off through the formation and/or through the screen 132. However, the screen 132 prevents the gravel in the slurry from flowing through the screen 132 so the carrying fluid returns alone through the annulus above the packer 14.

As the fluid leaks off, the gravel drops out of the slurry and packs the annulus. As described herein, the gravel can pack the annulus in an alpha-beta wave, although other variations can be used. For example, the gravel can generally pack along the low side of the annulus first and can collect in stages that progress from the toe (near the shoe track 140) to the heel in an alpha wave. Gravitational forces dominate the formation of the alpha wave, and the gravel settles along the low side at an equilibrium height along the screen section 130.

When the alpha wave of the gravel pack operation is done, the gravel then begins to collect in a beta wave along the upper side of the screen section 130 starting from the heel (near the packer 14) and progressing to the toe of the assembly 100. Again, the fluid carrying the gravel can leak through the screen section 130 and up the annulus between the inner work string 110 and screen 132.

After the gravel pack operation is done, operators preferably evacuate the inner work string 110 of excess slurry remaining therein. The circulation path for removing excess slurry is down the inner work string 110 and into the interior and/or exterior of the shoe track 140. To do this, the slurry can exit the end 114 of the inner work string 110. The slurry can fill the annulus around the shoe track 140 via toe port 154 and/or fill the interior of the shoe track 140.

Figure 2C:
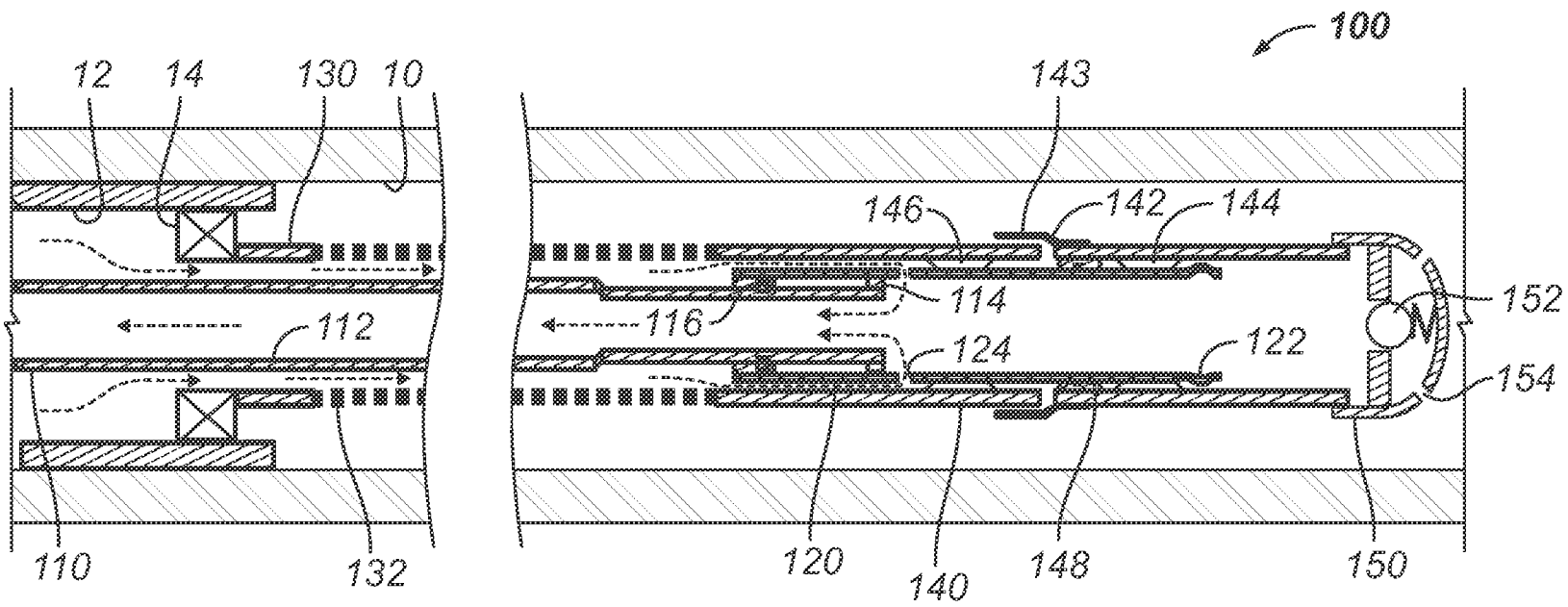
FIG. 2C shows the gravel pack assembly during reversing and bridge breaking operation.

If needed, the gravel pack assembly 100 can be optionally transitioned to a reverse bridge breaking condition as shown in FIG. 2C. In this condition, the inner work string 110 is pulled up in the assembly 100 with the sleeve 120 engaged by catch 116 so that the sleeve 120 moves along with the string 110. This causes the sleeve's intermediate ports 124 to move away from the track's flow ports 142 so that the upper seal 146 seals off fluid communication. At this point, reverse fluid pumped downhole outside the inner work string 110 can pass through the annulus between the sand screen 132 and the inner work string 110. This pumped fluid can break bridging or caking that may have developed during the gravel packing operation. The fluid and broken material can then pass through the sleeve's ports 124 and into the passage 112 through the open end 114 of the inner work string 110 to pass to the surface. With the work string 110 in this condition, the assembly 100 can also be operated to reverse out any excess gravel. When operations are completed, circulation can be reestablished so operators can stimulate the formation or remove the filter cake later if needed. Operators can remove the tool 110 so that the sleeve's catch 122 closes the sliding sleeve 148 over the ports 142.

For a gravel pack operation in an open hole, the assembly 100 of FIGS. 2A-2C eliminates the need for a crossover port downhole from the packer 14 and uphole from the screen 132. In addition, rather than gravel packing from the heel to the toe as conventionally done with a crossover arrangement, the disclosed assembly 100 gravels packs from the toe to the heel. For a frac pack operation when fracing of the borehole is done, the assembly 100 also eliminates the need for a crossover port, which experiences disadvantages from the frac stages of such an operation as noted previously in the Background.

Figure 3A:
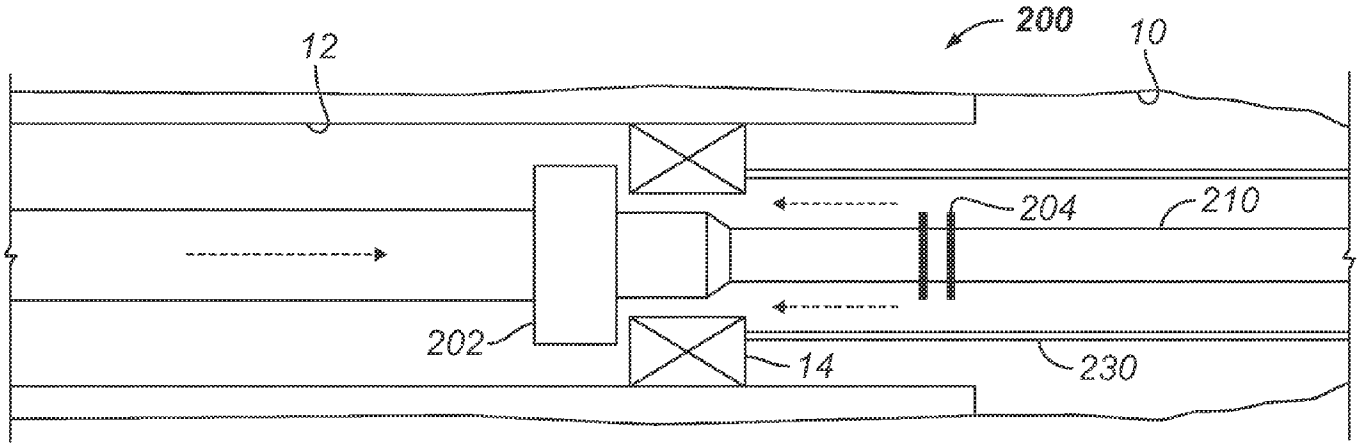
FIGS. 3A-3B show another gravel pack assembly according to the present disclosure being run-in hole for a wash down operation.
Figure 3B:
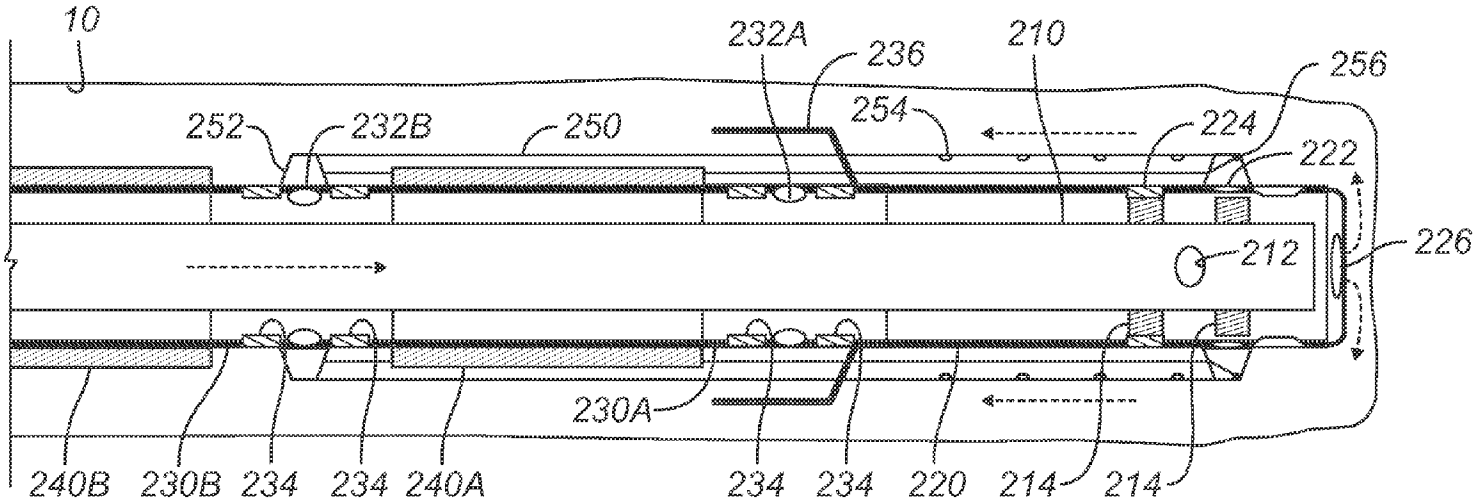

FIGS. 3A-3B show another gravel pack assembly 200 according to the present disclosure being run-in hole for a gravel pack operation. As shown in FIG. 3A, the gravel pack assembly 200 extends from a packer 14 downhole from casing 12 in a borehole 10. Again, this borehole 10 can be a horizontal or deviated open hole. The assembly 200 has a hydraulic service tool 202 made up to the packer 14 and has an inner work string 210 made up to the service tool 202. Along its length, the assembly 200 can have one or more screen sections 240A-B (FIG. 3B) and one or more ported housings 230A-B. In general, the ported housings 230A-B may be disposed next to or integrated into one or more of the screen sections 240A-B. Use of the one or more screen sections 240A-B and ported housings 230A-B provide one or more slurry packing points for a gravel packing operation as disclosed below.

Each of the ported housings 230A-B has body or flow ports 232A-B for diverting flow. Internally, each of the ported housings 230A-B has seats 234 defined above and below the outlet ports 232A-B for sealing with the distal end of the inner work string 210 as discussed below. To prevent erosion, the flow ports 232A-B on the ported housings 230A-B can have a skirt, such as the skirt 236 for the flow ports 232A on the ported housings 230A.

The flow ports 232B on an upper one of the ported housings 230B communicate with alternate path devices 250 disposed along the length of the lower screen section 240A. These alternate path devices 250 can be shunts, tubes, concentrically mounted tubing, or other devices known in the art for providing an alternate path for slurry. For the purposes of the present disclosure, however, the alternate path devices 250 are referred to as shunts herein for simplicity. In general, the shunts 250 communicate from the flow ports 232B to side ports 222 toward the distal end of the assembly 200 or other directions for use during steps of the operation.

As shown in FIG. 3B, the inner work string 210 extending from the service tool 202 (FIG. 3A) disposes through the screen sections 240A-B of the assembly 200. (The inner work string 210 can have a reverse taper to reduce circulating pressures if desired.) On the end of the screen sections 240A-B, the assembly 200 has a shoe track 220 with a float shoe 226 and seat 224. The float shoe 226 has a check valve, sleeve, or the like (not shown) that allows for washing down or circulating fluid around the outside the screen sections 240A-B when running in the well and before the packer 14 is set.

On its distal end, the inner work string 210 has outlet ports 212 isolated by seals 214. When running in, one of the seals 214 seal the end of the inner work string 210 inside the shoe track 220 as shown in FIG. 3B. In this way, fluid pumped downhole can exit the check valve (not shown) in the float shoe 226 at the end of the shoe track 220.

During the gravel pack operations, however, the outlet ports 212 can locate and seal by the seals 214 in the ported housings 230A-B disposed between each of the screen sections 240A-B. In particular, seals 214 located on either side of the string's outlet ports 212 seal inside seats 234 on the ported housings 230A-B. The seals 214 can use elastomeric or other types of seals disposed on the inner work string 210, and the seats 234 can be polished seats or surfaces inside the housings 230A-B to engage the seals 214. Although shown with this configuration, the reverse arrangement can be used with seals on the inside of the housings 230A-B and with seats on the inner work string 210.

When fluid is pumped through the inner work string 210, pumped fluid exits from the string 210 and through the flow ports 232A-B on the ported housings 230A-B depending on the location of the string 210 to the flow ports 232A-B. In this arrangement, the flow ports 232A in the lower ported housing 230A direct the slurry directly into the annulus, whereas the flow ports 232B in the upper ported housing 230B directs the slurry into shunts 250 as discussed below. Other similar arrangements can be used. In any event, this selective location and sealing between the string 210 and housings 230A-B changes fluid paths for the delivery of slurry into the annulus around the screen sections 240A-B during the gravel pack operations discussed in more detail below.

As shown in FIGS. 3A-3B, the assembly 200 is run-in hole for wash down. The service tool 202 sits on the unset packer 14 in the casing 12, and seals on the service tool 202 do not seal in the packer 14 to allow for transmission of hydrostatic pressure. The distal end of the inner work string 210 fits through the screen sections 240A-B, and one of the string's seals 214 seals against the seat 224 near the float shoe 226. Operators circulate fluid down the inner work string 210, and the circulated fluid flows out the check valve in the float shoe 226, up the annulus, and around the unset packer 14.

Figure 4A:
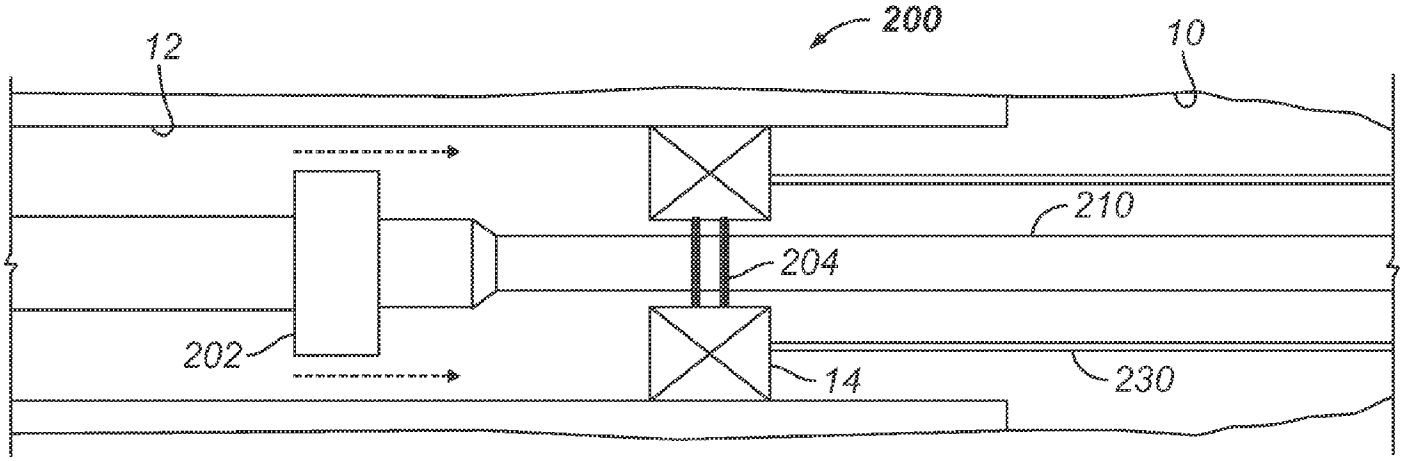
FIGS. 4A-4B show the gravel pack assembly during setting and testing of the packer.
Figure 4B:
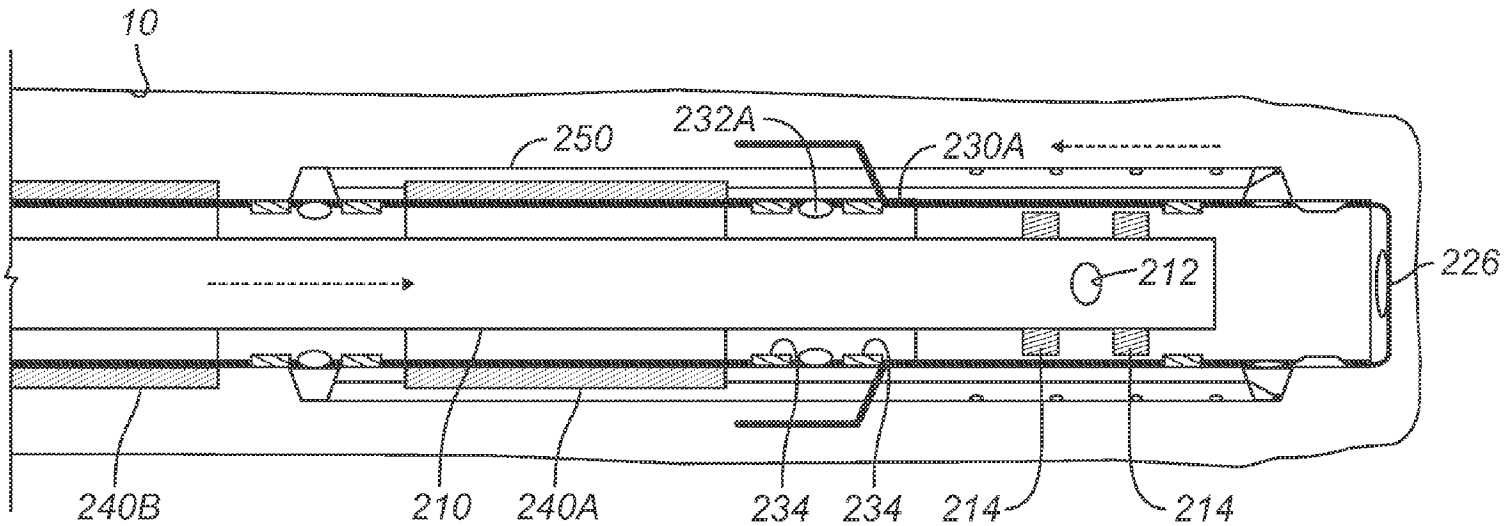

As shown in FIGS. 4A-4B, operators then set and test the packer 14. To set the packer 14, operators pump fluid downhole to hydraulically or hydrostatically set the packer 14 using procedures well known in the art, although other packer setting techniques can be used. To test the packer 14, a seal 204 on the service tool 202 is raised into the packer's bore after releasing from the packer 14. Operators then test the packer 14 by pressuring up the casing 12. Fluid passing through any pressure leak at the packer 14 will go into formation around the screen sections 240A-B. In addition, any leaking fluid will pass into the inner work string's outlet ports 212 and up to the surface through the inner work string 210. Regardless, the assembly 200 allows operators to maintain hydrostatic pressure on the formation during these various stages of operation.

Figure 5A:
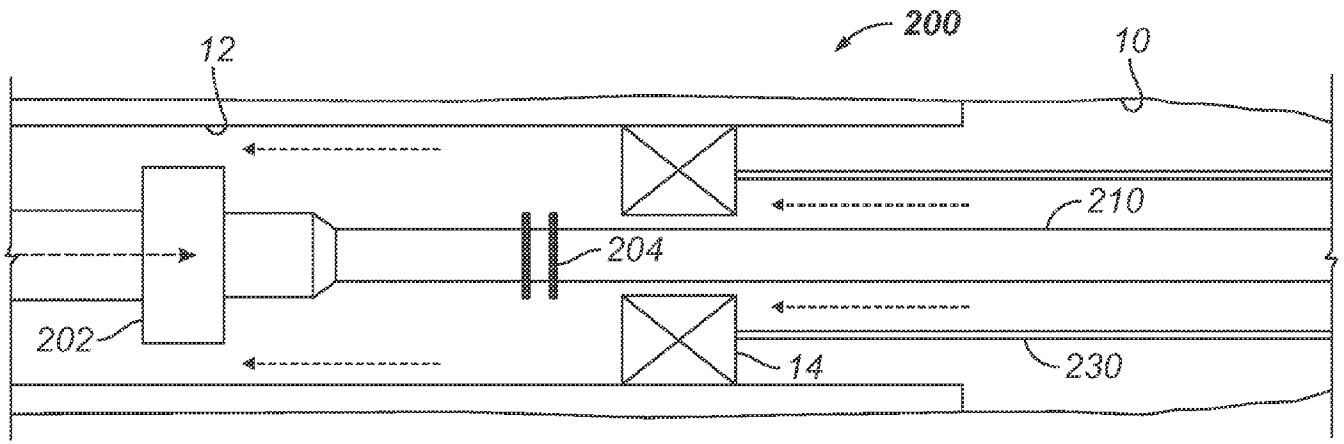
FIGS. 5A-5B show the gravel pack assembly during gravel pack operations.
Figure 5B:
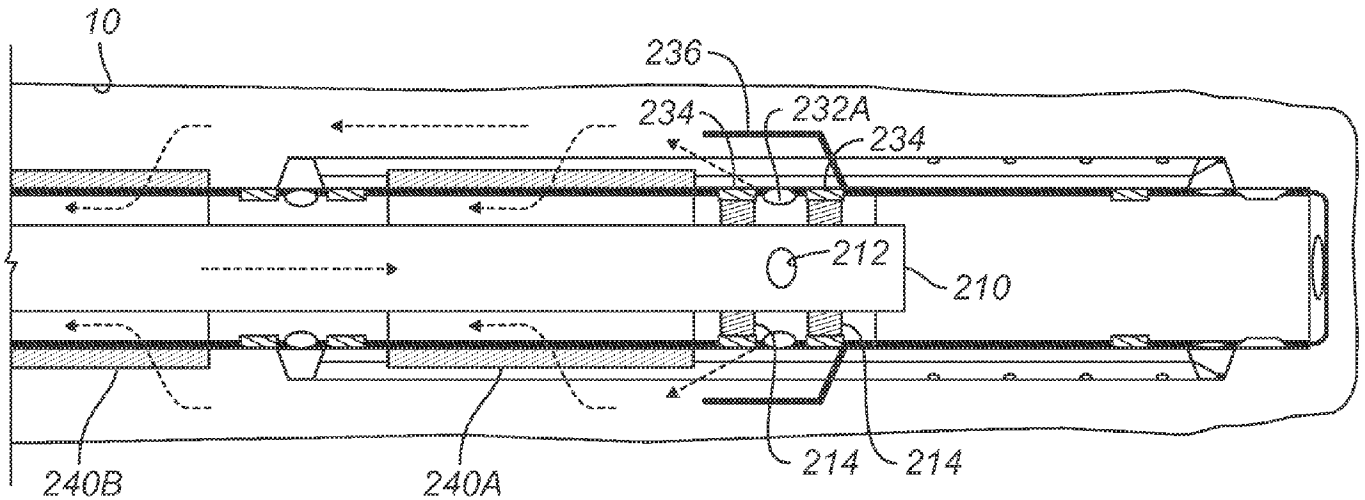

Once the packer 14 is set and tested, operators begin the gravel pack operation. As shown in FIGS. 5A-5B, operators raise the inner work string 210 to locate in a first gravel pack position. As shown in FIG. 5B, the string's seals 214 engage the seats 234 around the lower ports 232A below the lower screen section 240A. When this is done, the tool ports 212 communicate with the housing's ports 232A.

When manipulating the inner work string 210, operators are preferably given an indication at surface that the outlet ports 212 are located at an intended position, whether it is a blank position, a slurry circulating position, or an evacuating position. One way to accomplish this is by measuring tension or compression at the surface to determine the position of the inner work string 210 relative to the ported housings 230A-B and seats 234. This and other procedures known in the art can be used.

With the ports 212/232A isolated by engaged seals 214 and seats 234, operators pump the slurry of carrying fluid and gravel down the inner work string 210 in a first direction to the string's ports 212. The slurry passes out of the pipe's ports 212 and through the housing's ports 232A to the open hole annulus. As before, the carrying fluid in the slurry then leaks off through the formation and/or through the screen sections 240A-B along the length of the assembly 200. However, the screen sections 240A-B prevent the gravel in the slurry from flowing into the assembly 200. Therefore, the fluid passes alone through the screen sections 240A-B and returns through the casing annulus above the packer 14.

As described herein, the gravel can pack the annulus in an alpha-beta wave, although other variations can be used. As the fluid leaks off, for example, the gravel drops out of the slurry and first packs along the low side of the annulus in the borehole 10. The gravel collects in stages that progress from the toe (near housing 230A) to the heel in an alpha wave. As before, gravitational forces dominate the formation of the alpha wave, and the gravel settles along the low side at an equilibrium height along the screen sections 240A-B. After the alpha wave, the borehole 10 fills in a beta wave along the assembly 200 as discussed previously.

Figure 6A:
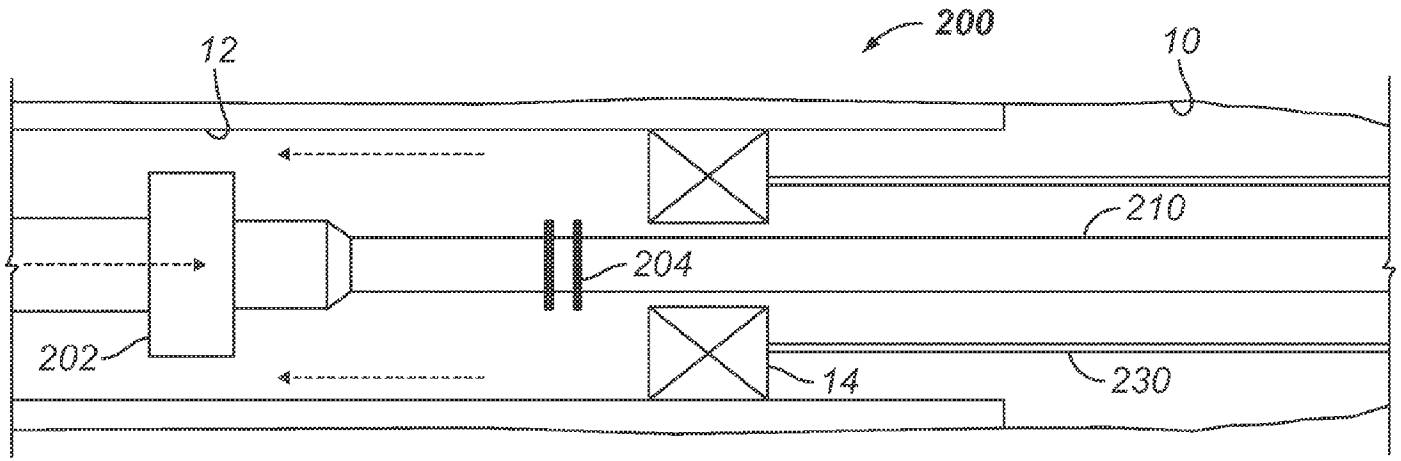
FIGS. 6A-6B show the gravel pack assembly during filling of the annulus around the shoe track to dump excess slurry.
Figure 6B:
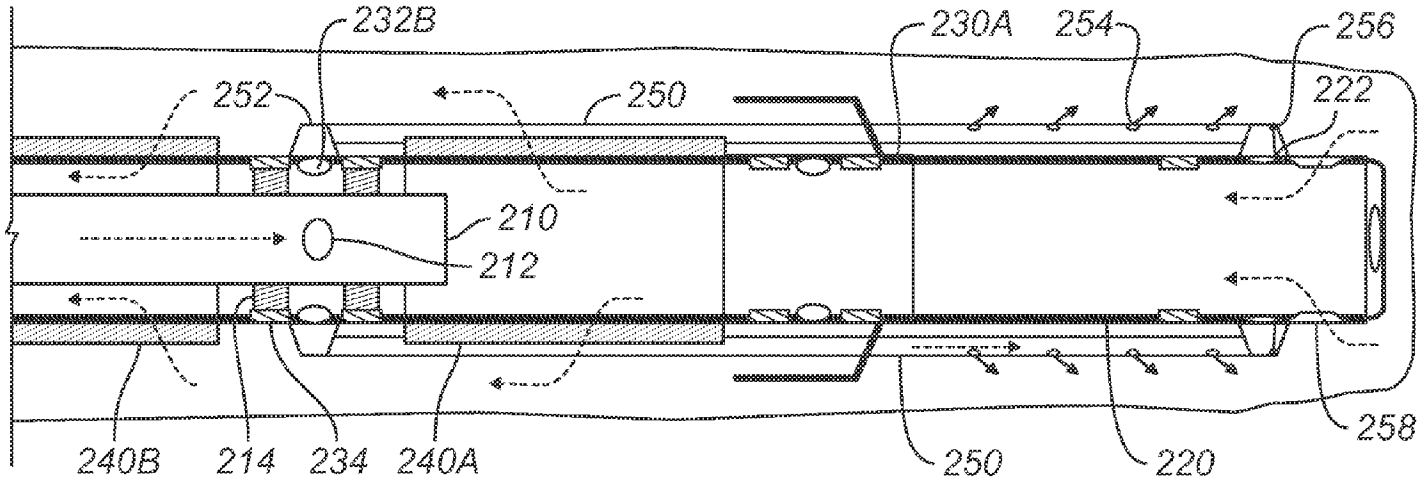

Eventually, the operators reach a desired state while pumping slurry at the ports 232A in this ported housing 230A. This desired state can be determined by a particular rise in the pressure levels and may be termed as "sand out" in some contexts. At this stage, operators raise the inner work string 210 again as shown in FIGS. 6A-6B. The seals 214 now seat on seats 234 around the ports 232B on the next ported housing 230B between the screen sections 240A-B. Operators pump slurry down the inner work string 210 again in the first direction to the outlet 212, and the slurry flows from the pipe's ports 212 and through the housing's ports 232B.

In general, the slurry can flow out of the ports 232B and into the surrounding annulus if desired. This is possible if one or more of the ports 232B communicate directly with the annulus and do not communicate with one of the alternate path devices or shunt 250. All the same, the slurry can flow out of the ports 232B and into the alternate path devices or shunts 250 for placement elsewhere in the surrounding annulus. Although shunts 250 are depicted in a certain way, any desirable arrangement and number of transport and packing devices for an alternate path can be used to feed and deliver the slurry.

Depending on the implementation, this second stage of pumping slurry may be used to further gravel pack the borehole. Yet, as shown in the current implementation, pumping the slurry through the shunts 250 enables operators to evacuate excess slurry from the string 210 to the borehole without reversing flow in the string from the first flow direction (i.e., toward the string's port 212). This is in contrast to the reverse direction of flowing fluid down the annulus between the string 210 and the housings 230A-B/screens 240A-B to evacuate excess slurry from the string 210.

As shown in FIG. 6B, the slurry travels from the port 212, through flow ports 232B, and through the shunts 250. From the shunts 250, the slurry then passes out the side ports or nozzles 254 in the shunts 250 and fills the annulus around shoe track 220. This provides the gravel packing operation with an alternate path different from the assembly's primary path of toe-to-heel. In this way, the shunts 250 attached to the ported housing 230B above the lower screen section 240A can be used to dispose of excess gravel from the work string 210 around the shoe track 220. The shunts 250 carry the slurry down the lower screen section 240A so a wash pipe is not needed at the end of the section 240A. However, a bypass 258 defined in a downhole location of the assembly 200 (or elsewhere) allows for returns of fluid during this process. This bypass 258 can be a check valve, a screen portion, sleeve, or other suitable device that allows flow of returns and not gravel from the borehole to enter the assembly 200. In fact, the bypass 258 as a screen portion can have any desirable length along the shoe track 220 depending on the implementation.

At some point, operation may reach a "sand out" condition or a pressure increase while pumping slurry at ports 232B. At this point, a valve, rupture disc, or other closure device 256 in the shunts 250 can open so the gravel in the slurry can then fill inside the shoe track 220 after evacuating the excess around the shoe track 220. In this way, operators can evacuate excess gravel inside the shoe track 220. As this occurs, fluid returns can pass out the lower screen section 240A, through the packed gravel, and back through upper screen section 240B to travel uphole. In other arrangements, the lower ported housing 230A can have a bypass, another shunt, or the like (not shown), which can be used to deliver fluid returns past the seals 214 and seats 234 and uphole.

Figure 7A:
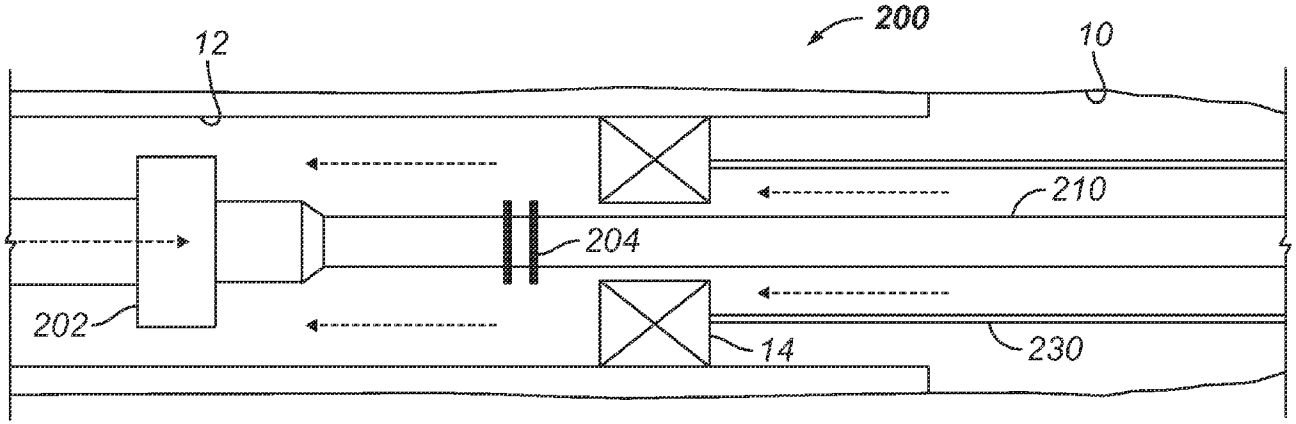
FIGS. 7A-7B show yet another gravel pack assembly according to the present disclosure having alternating shunts for gravel pack operations.
Figure 7B:
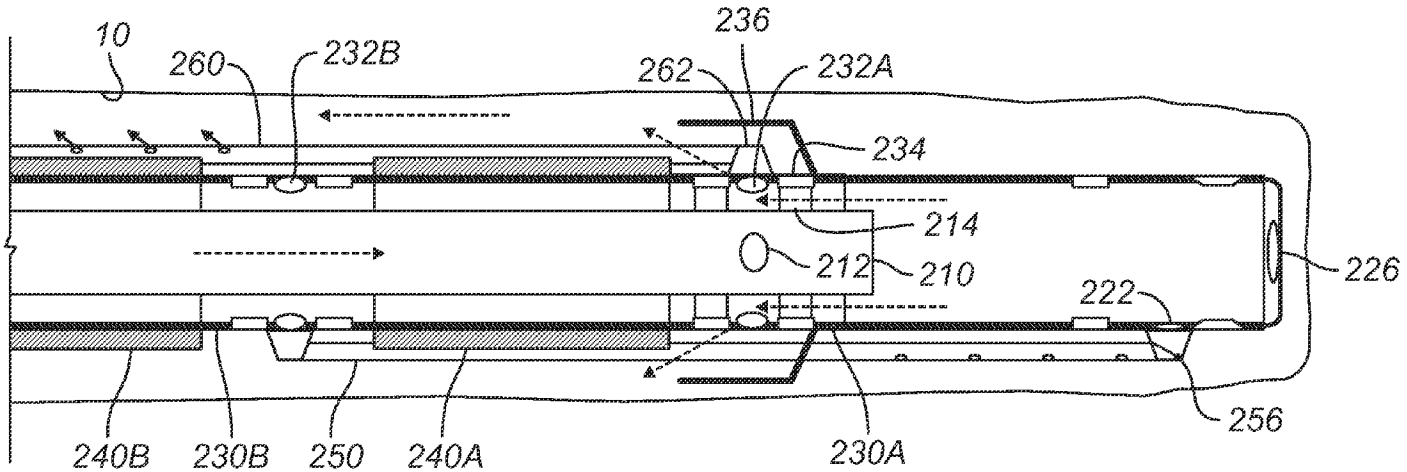

The previous assembly 200 filled the open hole annulus with an alpha-beta type wave and then filled the annulus around the toe with an alternate path. As shown in FIGS. 7A-7B, the assembly 200 can use an additional alternative path device or shunt 260 to fill the open hole annulus while circulating in the gravel pack operation. In this arrangement, the operation of the assembly 200 is similar to that discussed previously. Again, the assembly 200 has one or more ported housings 230A-B for the slurry to exit and has one or more screen sections 240A-B.

When operators raise the inner work string 210 to locate in the gravel pack position shown in FIG. 7B, operators pump at least some of the slurry into the open hole annulus using the additional shunts 260 in an alternative path gravel pack. The shunts 260 may be used exclusively. Alternatively, the slurry can be pumped out through one or more of the housing's ports 232A at the same time. By using an arrangement of shunts 250/260 and open flow ports 232, the assembly 200 can gravel pack zones from toe-to-heel, from heel-to-toe, and combinations thereof.

As can be seen in FIGS. 3A through 7B, the disclosed assembly 200 can be used in a number of versatile ways to gravel pack the annulus of a borehole. For example, the string's outlet ports 212 can locate in one or more different ported housings 230A-B to gravel pack around the screen sections 240A-B in an alpha-beta wave or alternative path. Additionally, the inner work string 210 can be moved to multiple housings 230A-B to pack a single zone from multiple points or to gravel pack the same zone from a first direction and then from a different direction (e.g., first from bottom to top and then from top to bottom using shunts 250/260).

Moreover, the inner work string 210 can be used to pump treatments of different types into a surrounding zone. For example, the assembly 200 of FIGS. 3A through 7B can be used to perform frac packing from one point and then gravel packing (via shunts 250 and/or 260) from another point along the screen sections 240A-B. In frac packing, operators perform a frac treatment by delivering large volumes of graded sand, proppant, or the like into the annulus and into the formation at pressures exceeding the frac gradient of the formation. The graded sand or proppant enters fractures in the borehole 10 to keep the fractures open. After the frac treatment, operators can then perform a gravel pack operation to fill the annulus with gravel. Alternatively, the gravel pack and frac treatment can be performed at the same time.

In a frac packing arrangement, the disclosed assembly 200 can deliver the frac treatment and gravel slurry through the multiple ported housing 230A-B into the annulus around the screen sections 240A-B. Dispersing the frac treatment and slurry through the multiple ports 232A-B can provide more even distribution across a greater area. For the fracturing part of the process, the frac treatment can exit from the lower ported housing 230A and return through the screen section 240B adjacent to the casing annulus until the fracture is complete. Afterwards, the inner work string 210 can be moved to the upper ported housing 230B so that gravel slurry can flow through shunts 250 and/or 260 to gravel pack the annulus. A reverse operation could be done in which frac treatment can exit upper housing 230B so that gravel packing can be done primarily at lower housing 230A.

When used for frac/gravel packing, the assembly 200 may reduce the chances of sticking. Because the assembly 200 can have a smaller volumetric area around the exit points, there may be less of a chance for proppant sticking around the gravel pack ports 212. As slurry exits near the end of the inner work string 210, only a short length of pipe has to travel upward through remaining slurry or dehydrated sand that may be left. If sticking does occur around the gravel pack ports 212, a shear type disconnect (not shown) can be incorporated into the inner work string 210 so that the lower part of the inner work string 210 can disconnect from an upper part of the inner work string 210. This allows for the eventual removal of the inner work string 210.

Figure 8:
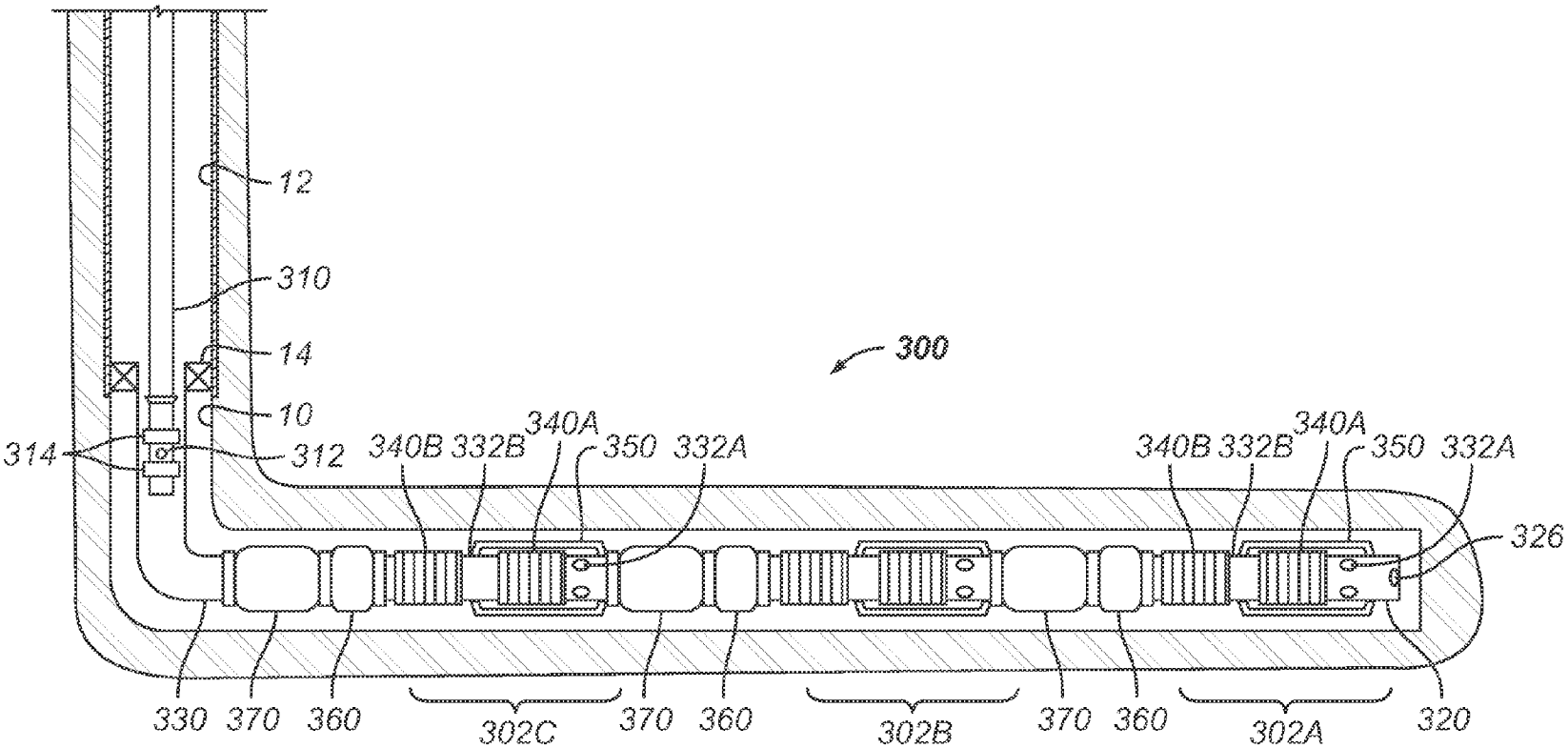
FIG. 8 shows an assembly having screen sections separated by packers.

Expanding on the versatility of the disclosed assembly, FIG. 8 shows an assembly 300 having several gravel pack sections 302A-C separated by packers 360/370. This assembly 300 segments several compartmentalized reservoir zones so that multiple gravel pack operations as well as frac operations can be performed. The packers 360/370 and gravel pack sections 302A-C are deployed into the well in a single trip. One packer 360/370 or a combination of packers 360/370 can be used to isolate the gravel pack sections 302A-C from one another. Any suitable packers can be used and can include hydraulic or hydrostatic packers 360 and swellable packers 370, for example. Each of these packers 360/370 can be used in combination with one another as shown, or the packers 360 or 370 can be used alone.

The hydraulic packers 360 provide more immediate zone isolation when set in the borehole 10 to stop the progression of the gravel pack operations in the isolated zones. For their part, the swellable packers 370 can be used for long-term zone isolation. The hydraulic packers 360 can be set hydraulically with the inner work string 310 and its packoff arrangement 314, or the packers 360 can be set by shifting sleeves (not shown) in the packers 360 with a shifting tool (not shown) on the inner work string 310.

Each gravel pack section 302A-C can be similar to the gravel pack assemblies 200 as discussed above in FIGS. 3A through 7B. As such, each gravel pack section 302A-C has two screens 340A-B, alternate path devices or shunts 350, and ports 232A-B and can have the ported housings and other components discussed previously. After the inner work string 310 deploys in the first gravel pack section 302A and performs wash down, the string's outlet ports 312 with its seals 314 isolates to the lower flow ports 332A to gravel pack and/or frac the first gravel pack section 302A. Then, the inner work string 310 can be moved so that the outlet ports 312 isolates to upper flow ports 332B connected to the shunts 350 to fill the annulus around the lower end of the first gravel pack section 302A. A similar process can then be repeated up the hole for each gravel pack section 302A-C separated by the packers 360/370.

The foregoing description of preferred and other embodiments is not intended to limit or restrict the scope or applicability of the inventive concepts conceived of by the Applicants. It will be appreciated with the benefit of the present disclosure that elements of one embodiment can be combined with or exchanged for components of other embodiments disclosed herein. As one example, the extendable sleeve 120 and other features of the embodiment of FIGS. 2A-2C can be used in other embodiments, such as those disclosed in FIGS. 3A through 6B. References have been made herein to use of the gravel pack assemblies in boreholes, such as open boreholes. In general, these boreholes can have any orientation, vertical, horizontal, or deviated. For example, a horizontal borehole may refer to any deviated section of a borehole defining an angle of 50-degrees or greater and even over 90-degrees relative to vertical.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A gravel pack apparatus, comprising:

a body for disposing in a borehole and having a heel and a toe, the body defining a body passage and defining at least one first body port and at least one second body port, the at least one first body port disposed toward the toe, the at least one second body port disposed toward the heel, the at least one first body port disposed in fluid communication via the borehole with the at least one second body port;

at least one first screen disposed on the body between the least one first body port and the least one second body port, the at least one first screen communicating between the body passage and the borehole, the at least one first screen disposed in fluid communication via the borehole with the at least one first and second body ports; and a tool movably disposing in the body passage and defining a tool passage with at least one tool port, the tool moved to a first selective position in the body passage sealing the at least one tool port with the at least one first body port toward the toe and communicating slurry from the tool passage to the borehole therethrough, the tool moved to a second selective position sealing the at least one tool port with the at least one second body port toward the heel and communicating slurry from the tool passage to the borehole therethrough.

2. The apparatus of claim 1, further comprising at least one first path device extending from the at least one first body port and communicating slurry from the at least one first body port to the borehole therethrough.

3. The apparatus of claim 2, wherein in the first selective position, the at least one first path device delivers slurry to the borehole toward the heel or the toe of the body.

4. The apparatus of claim 2, further comprising at least one second path device extending from the at least one second body port and communicating slurry from the at least one second body port to the borehole therethrough.

5. The apparatus of claim 4, wherein in the second selective position, the at least one second path device delivers slurry to the borehole toward the heel or the toe of the body.

6. The apparatus of claim 1, further comprising at least one path device extending from the at least one second body port and communicating slurry from the at least one second body port to the borehole therethrough.

7. The apparatus of claim 6, wherein in the second selective position, the at least one path device delivers slurry to the borehole toward the toe of the body.

8. The apparatus of claim 7, wherein the body comprises a bypass communicating flow returns from the borehole toward the toe to the body passage.

9. The apparatus of claim 6, wherein the at least one path device comprises an egress communicating from the at least one path device into the body passage.

10. The apparatus of claim 9, wherein the egress comprises a valve controlling communication between the at least one path device and the body passage.

11. The apparatus of claim 9, wherein in the second selective position, the egress delivers slurry into the body passage toward the toe of the body.

12. The apparatus of claim 1, wherein the tool in the first selective position delivers slurry in the borehole from the toe to the heel, and wherein the tool in the second selective position delivers slurry toward the toe of the body.

13. The apparatus of claim 1, wherein the body defines a toe port in the toe, and wherein the tool moved to a third selective position in the body passage seals the at least one tool port with the toe port and communicates the tool passage with the borehole therethrough.

14. The apparatus of claim 13, wherein the toe port comprises a valve controlling communication through the toe port.

15. The apparatus of claim 14, wherein the valve comprises a check valve preventing communication from the borehole into the body passage.

16. The apparatus of claim 1, further comprising at least one second disposed on the body between the at least one second body port and the heel and disposed in fluid communication via the borehole with at least one first screen.

17. The apparatus of claim 1, comprising a plurality of arrangements of the at least one first screen and the at least one first and second body ports disposed along the body.

18. The apparatus of claim 17, further comprising a plurality of packer elements disposed on the body between the arrangements of the at least one first screens and the at least one first and second body ports.

19. A borehole gravel pack method, comprising:

deploying an apparatus in a borehole downhole from a packer, the apparatus having a toe and a heel;

disposing a tool in a passage of the apparatus;

moving an outlet of the tool to a first flow port disposed between a first screen and the toe on the apparatus;

flowing slurry through the tool in a first flow direction to the outlet;

gravel packing the borehole by flowing slurry into the borehole from the toe to the heel through the first flow port; and evacuating excess slurry from a second flow port of the tool into the borehole toward the toe of the apparatus without reversing flow in the tool from the first flow direction by flowing slurry through the outlet moved to the second flow port disposed between the first screen and the heel of the apparatus.

20. The method of claim 19, wherein evacuating excess slurry further comprises evacuating excess slurry into the passage of the apparatus toward the toe.

21. The method of claim 19, wherein flowing slurry into the borehole from the toe to the heel through the first flow port comprises:

flowing slurry from the tool to the borehole through the first flow port, and flowing returns from the borehole through the first screen.

22. The method of claim 19, wherein evacuating excess slurry comprises:

moving the outlet of the tool to a second flow port disposed toward the heel;

flowing slurry through the tool in the first flow direction to the outlet; and flowing excess slurry from the tool into the borehole through the second flow port.

23. The method of claim 22, further comprising flowing returns from the borehole through a bypass in the apparatus.

24. The method of claim 22, wherein flowing excess slurry through the second flow port comprises flowing excess slurry from the tool into the borehole through an alternate path in communication with the second flow port.

25. The method of claim 24, further comprising flowing excess slurry from the alternate path into the passage of the apparatus toward the toe.

26. The method of claim 24, wherein flowing the slurry into the borehole from the toe to the heel through the first flow port comprises flowing slurry toward the heel through another alternate path communicating with the first flow port.

27. A borehole gravel pack method, comprising:

disposing a tool in a passage of an apparatus disposed in a borehole;

moving an outlet of the tool to a first flow port disposed between a first screen and a toe on the apparatus;

gravel packing the borehole by flowing slurry from the outlet of the tool into the borehole from the toe to the heel through the first flow port;

moving the outlet of the tool to a second flow port disposed between the first screen and the heel on the apparatus; and gravel packing the borehole by flowing slurry from the outlet of the tool into the borehole from the heel to the toe through a first path device communicating with the second flow port.

28. The method of claim 27, wherein flowing slurry from the outlet of the tool into the borehole from the heel to the toe through the first path device comprises evacuating excess slurry from the tool to the borehole without reversing flow in the tool.

29. The method of claim 28, wherein evacuating excess slurry further comprises evacuating excess slurry into the passage of the apparatus toward the toe.

30. The method of claim 27, wherein flowing slurry from the outlet of the tool into the borehole from the toe to the heel through the first flow port comprises flowing returns from the borehole through the first screen.

31. The method of claim 27, wherein flowing slurry from the outlet of the tool into the borehole from the heel to the toe through the first path device comprises flowing returns from the borehole through a bypass in the apparatus.

32. The method of claim 27, wherein flowing slurry from the outlet of the tool into the borehole from the toe to the heel through the first flow port comprises flowing slurry into the borehole from the toe to the heel through a second path device communicating with the first flow port.

33. A gravel pack apparatus, comprising:

a body for disposing in a borehole and having a heel and a toe, the body defining a body passage and defining at least one first body port and at least one second body port, the at least one first body port disposed toward the toe, the at least one second body port disposed toward the heel, the at least one first body port disposed in fluid communication via the borehole with the at least one second body port;

at least one first screen disposed on the body between the at least one first body port and the at least one second body port, the at least one first screen communicating between the body passage and the borehole, the at least one first screen disposed in fluid communication via the borehole with the at least one first and second body ports; and a tool movably disposed in the body passage and defining a tool passage with at least one tool port, the tool moved to a first selective position in the body passage sealing the at least one tool port with the at least one first body port toward the toe and delivering slurry from the tool passage to the borehole from the toe to the heel, the tool moved to a second selective position sealing the at least one tool port with the at least one second body port toward the heel and delivering slurry from the tool passage to the borehole toward the toe of the body.

34. The apparatus of claim 33, further comprising at least one path device extending from the at least one first body port and communicating slurry from the at least one first body port to the borehole therethrough.

35. The apparatus of claim 33, further comprising at least one path device extending from the at least one second body port and communicating slurry from the at least one second body port to the borehole therethrough.

36. The apparatus of claim 35, wherein the body comprises a bypass communicating flow returns from the borehole toward the toe to the body passage.

37. The apparatus of claim 35, wherein the at least one path device comprises an egress communicating from the at least one path device into the body passage.

38. The apparatus of claim 37, wherein the egress comprises a valve controlling communication between the at least one path device and the body passage.

39. The apparatus of claim 37, wherein in the second selective position, the egress delivers slurry into the body passage toward the toe of the body.

40. The apparatus of claim 33, further comprising at least one second screen disposed on the body between the at least one second body port and the heel and disposed in fluid communication via the borehole with the at least one first screen.

41. The apparatus of claim 33, comprising a plurality of arrangements of the at least one first screen and the at least one first and second body ports disposed along the body.

42. The apparatus of claim 41, further comprising a plurality of packer elements disposed on the body between the arrangements of the at least one first screens and the at least one first and second body ports.

43. A borehole gravel pack method, comprising:

deploying an apparatus in a borehole downhole from a packer, the apparatus having a toe and a heel;

disposing a tool in a passage of the apparatus;

moving an outlet of the tool to a first flow port disposed between a first screen and the toe on the apparatus;

flowing slurry through the tool in a first flow direction to the outlet;

gravel packing the borehole by flowing slurry into the borehole from the toe to the heel through the first flow port; and evacuating excess slurry from a second flow port of the tool into the passage of the apparatus toward the toe without reversing flow in the tool from the first flow direction by flowing slurry through the outlet moved to the second flow port disposed between the first screen and the heel of the apparatus.

44. The method of claim 43, wherein evacuating excess slurry comprises evacuating excess slurry from the second flow port into the borehole toward the toe of the apparatus.

45. The method of claim 43, wherein flowing slurry into the borehole from the toe to the heel through the first flow port comprises:

flowing slurry from the tool to the borehole through the first flow port, and flowing returns from the borehole through the first screen.

46. The method of claim 43, wherein evacuating excess slurry comprises:

moving the outlet of the tool to the second flow port disposed toward the heel;

flowing slurry through the tool in the first flow direction to the outlet; and flowing excess slurry from the tool into the borehole through the second flow port.

47. The method of claim 44, further comprising flowing returns from the borehole through a bypass in the apparatus.

48. The method of claim 44, wherein evacuating excess slurry comprises flowing excess slurry from the tool into the borehole through an alternate path in communication with the second flow port.

49. The method of claim 48, wherein evacuating excess slurry comprises flowing excess slurry from the alternate path into the passage of the apparatus toward the toe.

50. The method of claim 48, wherein flowing the slurry into the borehole from the toe to the heel through the first flow port comprises flowing slurry toward the heel through another alternate path communicating with the first flow port.

* * * * *